United States Patent [19]

Finkel

[11] 4,438,932

[45] Mar. 27, 1984

[54] APPARATUS FOR ELECTRONIC WORD GAME

[76] Inventor: Herbert Finkel, 714 Jackpine Ct., Sunnyvale, Calif. 94086

[21] Appl. No.: 951,477

[22] Filed: Oct. 16, 1978

[51] Int. Cl.[3] ..... A63F 3/06

[52] U.S. Cl. ..... 273/237; 273/1 E

[58] Field of Search ..... 273/1 E, 237, 265, 272, 273/273, 1 GC, DIG. 28; 35/6, 9 R, 9 A, 30, 31 R, 31 C; 364/410; 340/323 R; 377/5

[56] References Cited

U.S. PATENT DOCUMENTS

| | | | |
|---|---|---|---|
| 3,860,239 | 1/1975 | Feuer et al. | 273/88 |
| 3,948,526 | 4/1976 | Lukacik | 273/265 X |
| 4,012,044 | 3/1977 | Grossi | 273/265 |
| 4,044,380 | 8/1977 | Justice et al. | 35/9 R |
| 4,055,907 | 11/1977 | Henson | 35/6 X |
| 4,059,272 | 11/1972 | Pullman | 273/237 X |
| 4,122,444 | 10/1978 | Kitajima et al. | 35/6 X |
| 4,126,949 | 11/1978 | Simone | 35/31 C |
| 4,189,779 | 2/1980 | Brautingham | 364/718 |

OTHER PUBLICATIONS

*Products That Think;* JS & A National Sales Group Catalog; 1978; pp. 40–41.

*Primary Examiner*—Vance Y. Hum

*Attorney, Agent, or Firm*—Jack M. Wiseman

[57] ABSTRACT

Apparatus for an electronic word game in which is displayed a word selected by the actuation of letter keys by one player. Also displayed is a pictorial illustration of the anatomy of a person on gallows. The selected word is blanked out so as not to be observed by another player, although the other player can observe the number of letters in the selected word. The other player selects successively letters to arrive at the spelling of the selected word. Letter keys are actuated in accordance with the letters selected by the other player. Each incorrect selection of a letter by the other player results in a different part of the anatomy being sequentially lighted, i.e. neck, arms, torso and legs. Should the entire anatomy be lighted, the other player has lost the game. Should all the letters of the selected word be correctly selected, the other player has won the game. A clear key is actuated for the start of a new word selection.

15 Claims, 2 Drawing Figures

WORD
4 LETTERS
ON
OFF
NUMBER L.E.D.
DECODER
LATCH
PULSE GEN.
O. S.
BIN CNTR
SEQUENCER
ALPHA L.E.D.
REG.
FF D
C L
PL

APPARATUS FOR ELECTRONIC WORD GAME

BACKGROUND OF THE INVENTION

The word game "Hangman" has been known for many years. It has been played by two players generally on a piece of paper. One player writes a selected word and conceals it from the other player. The first player designates a dash for each letter in the selected word. The other player selects in succession letters to arrive at the selected word. Correct letters are placed at the dashes and incorrect letters are recorded sequentially as parts of the anatomy of a person on gallows. A correct selection of the letters by the other person before the anatomy of a person on gallows is completed results in the other person winning the game. The completion of the anatomy of a person on gallows before the selected word is completed results in the other person losing the game.

National Semiconductor Corp. of Santa Clara, Calif., has introduced the "Quiz Kid Speller," which is a calculator with letter keys for entertaining children as it teaches them to spell. Different lights flash to indicate a correct spelling or an incorrect spelling. It is also programmed for a variety of spelling games.

In the patent to Lukacik, U.S. Pat. No. 3,948,526, issued on Apr. 6, 1976, for Game Apparatus For A Game Of Hangman, there is disclosed a playing board with a plurality of rows of apertures. Letter pegs are inserted into the holes for forming a word. A plurality of body parts are formed on scaffolds, which are hingedly mounted on the board. The word concealed from one of the players is formed on a piece of paper held to the board.

The patent to Gross; U.S. Pat. No. 4,012,044, issued on Mar. 15, 1977, for Hangman Game Apparatus discloses a gallow with a trap door over which a noose hangs. Magnetic parts of the anatomy of a person are provided, such as the head, torso, arms, legs, hands and feet. A rack of letter blocks is secured to the platform to construct a preselected word. A spinner is operated to select the number of letters to be included in the selected word.

Lastly, the patent to Feuer et al., U.S. Pat. No. 3,860,239, issued on Jan. 14, 1975, for Electronic Baseball Game, discloses transmitters which are actuated for pitching a ball and for hitting the ball. The trajectory of the ball is displayed on a screen. The screen displays the hit, location of the runners on the baseball diamond and the progress of the ball game.

SUMMARY OF THE INVENTION

Apparatus for an electronic word game in which one player selects a word by actuating letter keys. The word selected is displayed electronically and subsequently blanked out to be concealed from the other player. The other player selects letters in succession to arrive at the spelling of the selected word. Letter keys are actuated in accordance with the selected letters to be compared electronically with the letters of the selected word by the apparatus. The incorrect selection of one or more letters results in the fragmentary display of a recognizable object.

DESCRIPTION OF THE PREFERRED EMBODIMENT

Figures 1, 2A:
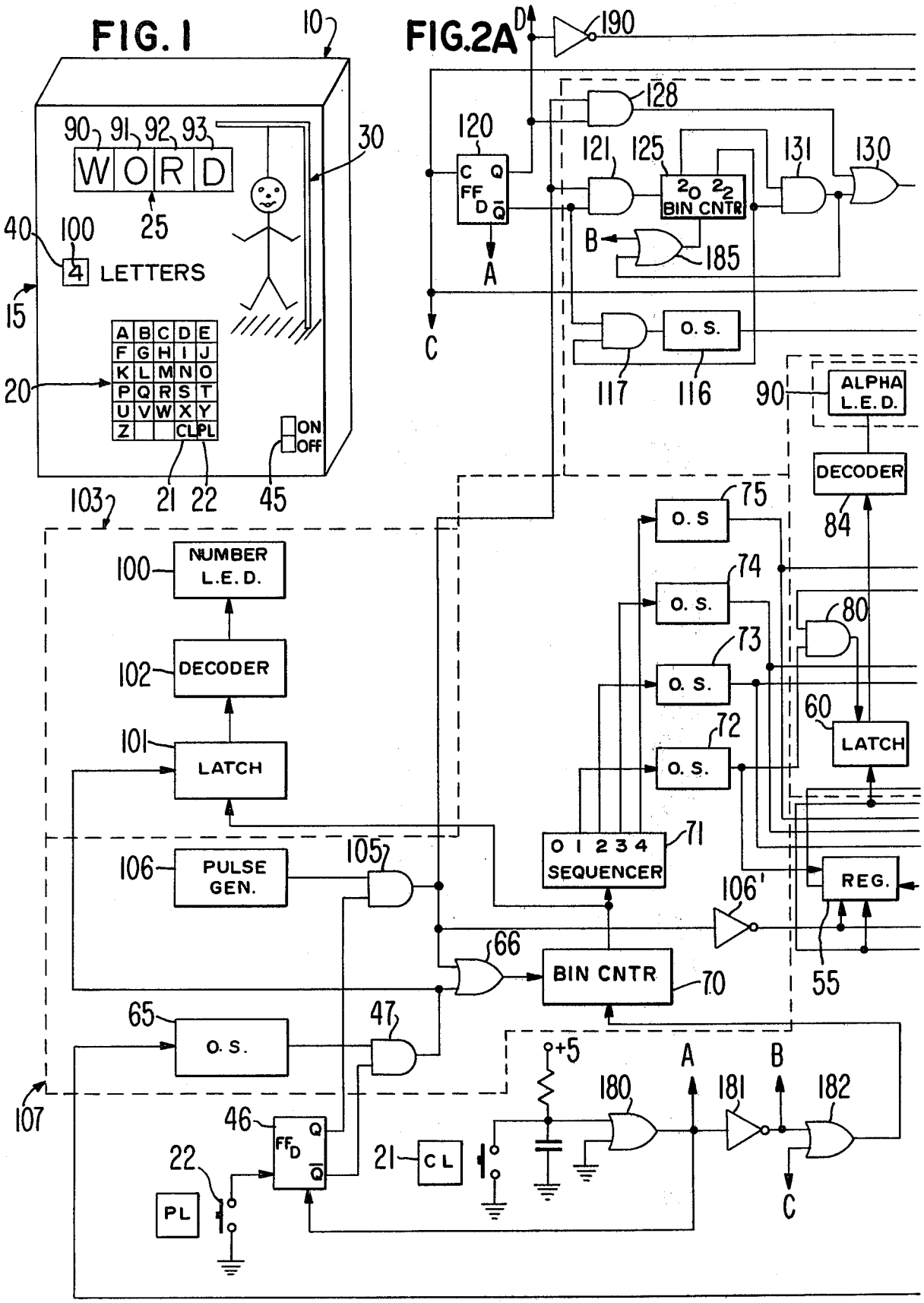
FIG. 1 is a perspective view of the apparatus for an electronic word game embodying the present invention.

Illustrated in FIG. 1 is the apparatus 10 for an electronic word game embodying the present invention. The apparatus 10 comprises a suitable plastic housing 15 of the type that can be held in the hand. Mounted on the housing 15 is a suitable keyboard 20 having well-known letter keys. The alpha keyboard 20 is well-known in the art. Additionally, keys, such as a clear key 21 and a play key 22 are also included in the keyboard 20. A word display 25 is also mounted on the housing 15. One player actuates the keys of the keyboard to select a word to be displayed on the word display 25. While the word display is shown to accommodate four letter words or less, one skilled in the art can increase the number of letters in a word to be accommodated by the apparatus 10.

A transparency 30 of the anatomy of a person on gallows is also displayed on the housing 15. Behind the transparency 30 are mounted suitable illuminating devices, such as light emitting diodes 31–35, the energization of which will illuminate the transparency 30 at the part of the anatomy associated with the energized light emitting diodes. While a hangman is displayed, it is apparent that any recognizable object can be segmentally or fragmentally illuminated in lieu of the hangman. A display 40 is mounted on the housing 15 to indicate the number of letters in the selected word displayed in the word display 25. A suitable on-off switch 45 is mounted on the housing 15 to turn on and off the power supply, not shown.

Normally, a flip-flop 46 (FIG. 2A) is set. The reset output of the flip-flop 46 is connected to one input of an AND gate 47 to enable the AND gate 47. One of the players now selects a word to be displayed in the word display 25. Toward this end, the one player actuates the keys of the alpha keyboard 20 in the sequence to spell out the word selected to appear in the word display 25. The output of the alpha keyboard 20 is applied sequentially to a 5-bit encoder circuit 50 (FIG. 2B), which is in the form of a well-known diode matrix to produce in sequence a 5-bit encoded signal for each letter key of the alpha keyboard 20 actuated. The alpha keyboard 20 and the 5-bit encoder circuit 50 form a suitable keyboard circuit 51.

The output of the 5-bit encoder circuit for each actuated letter key is applied in parallel to shift registers 55–58 and latch circuits 60–63. The latch circuits 60–63 control the illumination of the word display 25 and the shift registers 55–58 store 5-bit encoded signals representing actuated letter keys of the letters of the selected word to be advanced for storage in a memory circuit. As each letter key is actuated for displaying a letter in word display 25, a one-shot multivibrator 65 is operated. The output of the one-shot multivibrator 65 is applied to the other input circuit of the AND gate 47 so that the AND gate 47 conducts each time a letter key is actuated for displaying a letter in word display 25. The output of the AND gate 47 is connected to one input of an OR gate 66. The output of the OR gate 66 is connected to a binary counter 70. The OR gate 66 conducts each time the AND gate 47 conducts for pulsing the binary counter 70.

A sequencer circuit 71 is connected to the output of the binary counter 70. Connected to the output of the sequencer circuit 71 are one-shot multivibrators 72–75. Decoder circuits 84–87 are connected respectively to the output circuits of the latch circuits 60–63. Interconnecting the one-shot multivibrators 72–75 and the latch circuits are AND gate circuits 80–83. Connected to the output of the decoder circuits 84–87, respectively, are alpha light emitting diodes of the word display 25. The latch circuits 60–63, the AND gates 80–83, the decoder circuits 84–87 and the alpha light emitting diodes 90–93 form a display circuit 94.

The actuation of the first letter key of the alpha keyboard 20 by the one player applies a 5-bit encoded signal representing the first selected letter of the selected word to the shift registers 55–58 and the latch circuits 60–63 through the 5-bit encoder circuit 50. The flip-flop circuit 46 is set to enable the AND gate 47. The actuation of the first letter key of the alpha keyboard operates the one-shot multivibrator 65. Thereupon, the AND gate 47 conducts and the OR gate 66 conducts to pulse the binary counter 70. The output of the binary counter 70 stepped the sequencer circuit 71 to operate the one-shot multivibrator 72. As a consequence thereof, the shift register 55 is set and the latch circuit 60 is latched through the AND gate 80. When the latch circuit 60 is latched, the decoder 84 applies a voltage to the light emitting diode 90 to display on the word display 25 the first selected letter of the word selected by the one player. The shift register 55 stores the encoded signal representing the first selected letter of the selected word.

The actuation of the second letter key of the alpha keyboard 20 by the one player applies a 5-bit encoded signal representing the second letter of the selected word to the common input bus of the shift registers 55–58 and the latch circuits 60–63 through the 5-bit encoder circuit 50. The flip-flop circuit 46, the one-shot multivibrator 25, the AND gate 47, OR gate 66, binary counter 70 and sequencer circuit 71 perform in a manner similar to that previously described for the first letter. The sequencer circuit 71 now operates the one-shot multivibrator 73, which enables the AND gate 81. As a result thereof, the shift register 56 is set through the pulsing of the one-shot multivibrator 73 and the latch circuit 61 is latched through the AND gate 81. Thereupon, the decoder 85 through the latching of the latch circuit 61 applies a voltage to the light emitting diode 91 to display on the word display 25 the second selected letter of the word selected by the one player. The shift register 56 stores the encoded signal representing the second selected letter of the word selected by the one player.

The operation for the third selected letter of the selected word is similar to that previously described. However, the sequencer circuit 71 operates the one-shot multivibrator 74, which enables the AND gate 81. Hence, the shift register 57 is set through the pulsing of the one-shot multivibrator 74, and the latch circuit 62 is latched through the AND gate 83. The decoder 86 through the latching of the latch circuit 62 applies a voltage to the light emitting diode 92 to display on the word display 25 the third selected letter of the word selected by the one player. The shift register 57 stores the encoded signal representing the third letter of the word selected by the one player.

For the fourth selected letter of the selected word, a similar operation takes place. This time the sequencer circuit 71 operates the one-shot multivibrator 75, which enables the AND gate 82. The shift register 58 is set through the pulsing of the one-shot multivibrator circuit 75, and the latch circuit 63 is latched through the AND gate 83. The decoder 87 through the latching of the latch circuit 63 applies a voltage to the light emitting diode 93 to display on the word display 25 the fourth selected letter of the word selected by the one player. The shift register 58 stores the encoded signal representing the fourth letter of the word selected by the one player.

The number of letters of the selected word by the one player is displayed on the number display 40, which includes a number light emitting diode 100. Each time a letter key of the alpha keyboard 20 is actuated to select a letter for the word selected by the one player, the one-shot multivibrator 65 is operated and enables the AND gate 47. In turn, the AND gate 47 while conducting, sets a latch 101. The conduction of the AND gate 47 operates the binary counter 70 through the OR gate 66. The binary counter 70 has its output, when pulsed by the AND gate 47, applied to the latch 101 to latch the same. The output of the latch 101 is connected to a decoder circuit 102 and the latching of the latch circuit 101 operates the decoder 102. The operated decoder circuit 102, in turn, applies a voltage to the light emitting diode 100, to display on the number display 40 the number of letters of the selected word. The light emitting diode 100, the encoder circuit 102, and the latch circuit 101 comprise a number display circuit 103.

Figure 2B:
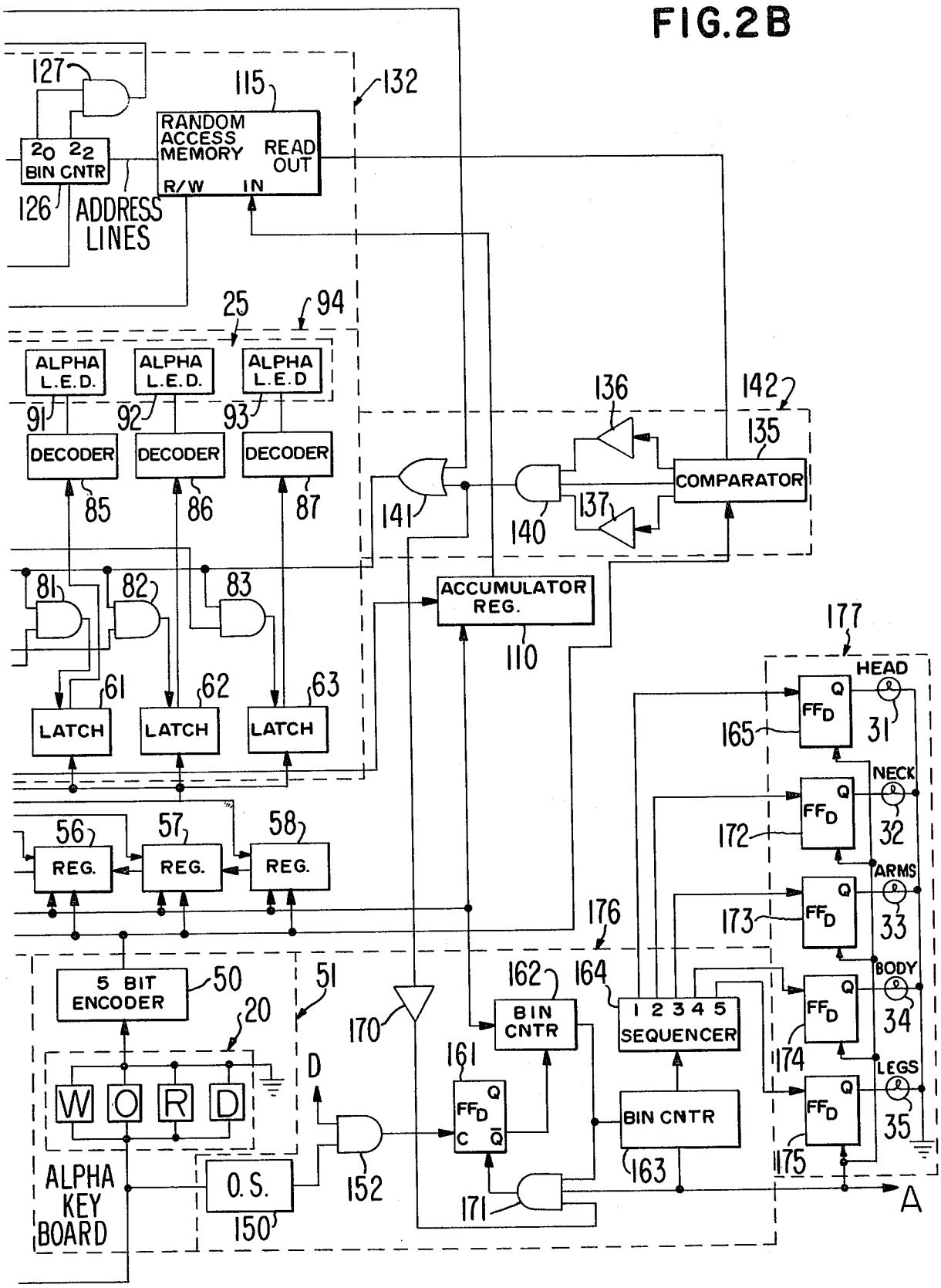
FIG. 2 is a schematic diagram of the electronic circuitry employed in the apparatus shown in FIG. 1.

At this time, the one player actuates a play switch 22 to blank out the word display 25 to conceal it from the other player, and the selected word will be stored in a memory circuit to be compared with the letters selected by the other player. The actuation of the play switch 22 results in the change of state of the flip-flop circuit 46 (FIG. 2A) to disable the AND gate 47 and to enable an AND gate 105. Connected to the AND gate 105 is a suitable clock pulse generator 106' operating at a clock pulse frequency of 10 KHZ. The sequencer circuit 71, the binary counter 70, the one-shot multivibrator circuits 72–75, the inverter circuit 106, the OR gate 66, the AND gate 105, the AND gate 47, the one-shot multivibrator circuit 65 and the pulse generator 106 comprise a sequence pulsing circuit 107. Shift pulses from the clock pulse generator 106 are conducted through the AND gate 105 and through an inverter circuit 106'. Thereupon, the shift pulses are applied to the shift registers 55–58 and an accumulator register 110 (FIG. 2B). The encoded letters stored in the shift registers 55–58 as above described are advanced serially to the accumulator register 110.

The shift pulses from the clock pulse generator 106 are also applied through the AND gate 105 and the OR gate 66 to the binary counter 70. The output of the binary counter 70 steps the sequencer circuit 71, which, in turn, operates the one-shot multivibrators 72–75 sequentially at clock rate. The operation of the one-shot multivibrators 72–75 produces pulses through the AND gates 80–83 to clear the latch circuits 60–63. The latch circuits 60–63 are cleared in sequence, because there are no signals on the input bus at this time and the pulse applied, in effect, transfers the absence of a signal from the input of the latch circuits 60–63 to the output of the latch circuits 60–63. The clearing of the latch circuits 60–63, in turn, clears the decoder circuits 84–87 for blanking the light emitting diodes 90–93. Thus, the display of the selected word in the word display 25 is blanked and the other player cannot observe the word selected by the first player.

The output of the accumulator register 110 is connected to a RAM memory 115 (FIG. 2B). The accumulator register 110 receives the 5-bit encoder signals for the respective letters of the selected word in series and applies the 5-bit encoder signals for the respective letters of the selected word in parallel to the RAM memory 115.

Connected to the read/write input of the RAM memory 115 is a one-shot multivibrator 116 (FIG. 2A). The one-shot multivibrator 116 is operated when an AND gate 117 is enabled. One input of the AND gate 117 is connected to a normally reset flip-flop circuit 120. The other input of the AND gate 117 is connected to the output of a binary counter circuit 125. The input of the binary counter circuit 125 is connected to an AND gate 121. One input of the AND gate 121 is connected to the pulse generator 106 through the AND gate 105. The other input of the AND gate 121 is connected to a normally reset flip-flop circuit 120. Through this arrangement, for every five shift pulses applied to the accumulator register 110 from the clock pulse generator 106, one write pulse is generated by the one-shot multivibrator 116 for application to the RAM memory 115. The operation of the one-shot multivibrator 116 is controlled by the conduction of the AND gate circuit 117, which is enabled by the flip-flop circuit 120 and the binary counter 125. The binary counter 125, in turn, is pulsed by the clock pulse generator 106 through the conducting AND gate 105 and the conducting AND gate 121. Thus, each 5-bit encoder signal representing a letter of the selected word is stored in the RAM memory 115.

At the same time, a write pulse is generated by the one-shot multivibrator 116, and a binary counter 126 opens address 1 in the RAM memory 115. In this manner, the first letter of the selected word is stored in address one. The second letter of the selected word is stored in address two. The third letter of the selected word is stored in address three and the fourth letter of the selected word is stored in address four.

Toward this end, the input of the binary counter 126 is connected to an OR gate 130. One input of the OR gate 130 is connected to an AND gate 131. The inputs of the AND gate 131 are connected to the output of the binary counter 125. The other input of the OR gate 130 is connected to the output of an AND gate 128. In turn, the AND gate 128 is connected to the output of the clock pulse generator 106 through the AND gate 105. Through this arrangement, the binary counter 126 is pulsed during each 5-bit encoded signal representing a respective letter of the selected word for addressing each letter respectively in the RAM memory 115.

When the four letters of the selected four letter word are stored in the RAM memory 115, a pulse from the binary counter 126 is applied through an AND gate 127 to the flip-flop circuit 120 to change its state. The change of state of the flip-flop circuit 120 enables the conduction of the AND gate 128, and resets the binary counter 70 through 182 (FIG. 2A) OR gate. The binary counter 126 is reset through the AND gate 127 (FIG. 2B). The resetting of the binary counter 70 and the binary counter 126 locks them in synchronism on a one-to-one clock pulse ratio. Previously, the binary counter 70 and the binary counter 126 were locked in synchronism in a five-to-one clock pulse ratio. Additionally, the AND gate 121 and the AND gate 117 are disabled by the change of state of the flip-flop circuit 120. The one-shot multivibrator 116 is inhibited from operating and no further write pulses are applied to the RAM memory 115. This places the RAM memory 115 in a read mode. The RAM memory 115, the AND gate 127, the binary counter 126, the OR gate 130, the AND gate 131, the binary counter 125, the AND gate 128, the AND gate 121, an OR gate 185, the AND gate 117 and the one-shot multivibrator circuit 116 form a memory circuit 132.

At this time, the first letter of the word selected by the one player is being read out of the RAM memory 115. Simultaneously, the sequencer circuit 71 is generating a pulse. The pulse generated by the sequencer circuit 71 operates the one-shot multivibrator 72 to set the latch circuit 60 through the AND gate 80.

At this time, the clock pulses are continuously reading out of the memory the letters of the selected word sequentially in the same order in which the letters of the selected word were written into the memory 115. The binary counter 126 and the sequencer 71 are in 1:1 synchronism and every fifth clock pulse resets the counter 126 and the sequencer as above-described. For example, if W-O-R-D were stored in the memory 115, it would read out to the input of a comparator 135 (FIG. 2B) W-O-R-D in a repetitive manner at a 10 Khz rate.

The other player now actuates a letter key of the alpha keyboard 20 which he selects to be a first letter of the word selected by the one player. The letter key actuated by the other player produces a 5-bit encoded signal through the 5-bit encoder 50 representing the letter key actuated by the other player. The 5-bit encoded signal representing the first letter selected by the other player is applied to one input of a comparator 135. Simultaneously, the other input of the comparator 135 is receiving from the memory 115 the sequential read out of the letters of the word selected by the one player from the RAM memory 115.

Connected to the output of the comparator 135 are inverter circuits 136 and 137. The comparator 135 and the inverter circuits 136 and 137 are connected to a three input AND gate 140. The output of the AND gate 140 is connected to an input of an OR gate 141. The output of the OR gate 141 is connected to the latch circuits 60–63 through the AND gates 80–83. The comparator 135, the inverter circuits 136 and 137, the AND gate 140 and the OR gate 141 comprise a comparator circuit 142.

If the first letter selected by the other player is a letter of the word selected by the one player, a positive going pulse is emitted from the comparator circuit 142, which simultaneously enables the four AND gates 80–83. If the letter selected by the other player is the first letter of the selected word, for example, the sequencer 71 will cause only the one-shot 72 to emit a positive going pulse at that instant to the AND gate 80. In turn, the AND gate 80 will apply a positive going pulse to the latch circuit 60 and the binary coded signal on the common input bus to latch circuits 60–63 representing the selected letter will be transferred to the output of the latch circuit 60. Also, the binary coded signal will be held by the latch circuit 60 and displayed in its proper place in the word selected by the one player. Should the first selected letter represent the second letter of the selected word, then the sequencer 71 will (synchronized with the memory 115 readout) cause a pulse to be generated by the one shot 73, which, in turn, will result in a positive going pulse from the AND gate 81 being applied to the latch circuit 61. As a consequence thereof, the latch circuit 61 holds the binary coded signal representing the selected letter and the selected letter is displayed in the word display 25 at its correct location for the spelling of the selected word.

If the other player does not select correctly a letter of the word selected by the one player, a low level signal is emitted from the comparator 135 through the inverter circuits 136 and 137, AND gate 140, OR gate 141, and AND gates 80–83. With a low level signal applied to the latch circuits 60–63, the latch circuits 60–63 are disabled. As a consequence thereof, some of the decoder circuit 84–87 is operated and none of the alpha light emitting diodes 90–93 is energized. Thus, no letter appears on the word display 25.

When a letter key of the alpha keyboard 20 is actuated, a one-shot multivibrator 150 (FIG. 2B) is operated. The disabled pulse generated by the one-shot multivibrator 150 triggers a flip-flop circuit 161 through an AND gate 152. The AND gate 152 prevents the operation of the light emitting diodes 31–35 during the word selection mode. The flip-flop circuit 161 normally holds a binary counter 162 in the reset state to inhibit it from counting. When the flip-flop 161 changes its state through the pulse emitted from the one-shot multivibrator 150, the binary counter 162 is in a set state and initiates a count at the same rate that the RAM memory 115 is reading out the letters sequentially of the stored word selected by the one player. The clock pulses from the pulse generator 106 are applied to the binary counter 162 through the AND gate 105 and the inverter circuit 106'.

The binary counter 162 counts to a preselected pulse count and thereupon pulses a binary counter 163. A pulse from the binary counter 163 steps a sequencing circuit 164. The first step of the sequencing circuit 164 sets a flip-flop circuit 165 to apply a voltage to the head light emitting diode 31 of the hangman transparency 30. The one-shot multivibrator 150, the AND gate 152, the flip-flop circuit 161, the binary counter 162, the AND gate 171, the sequencer circuit 164, the binary counter 163 and the inverter circuit 170 form a pulsing circuit 176 for illuminating an object sequentially or fragmentally.

When the other player selects the actuating letter key that correctly selects a letter of the word selected by the one player, the positive going pulse emitted by the comparator circuit 142 is inverted by the inverter circuit 170 and the negative going pulse is applied to the flip-flop circuit 161 to return the flip-flop circuit 161 to its initial state. In so doing, the flip-flop circuit 161 resets the binary counter 162 to inhibit it from counting and the sequencer circuit 164 is not stepped, since the binary counter 163 remains in its initial state. When the sequencer circuit 164 is not stepped, there is no triggering of the flip-flop circuit 165. The failure to trigger the flip-flop circuit 165 will not result in the light emitting diode 31 being energized.

If the first letter selected by the other player is not contained in the word selected by the one player, then no pulse is generated by the comparator circuit 142 and the binary counter 162 completes its preset count. This action allows sufficient time for the comparator circuit 142 to compare the selected letter with every letter contained in the selected word. The letters of the selected word are continuously read out of the memory 115 in serial order. At the end of the uninterrupted preset count a negative going pulse is applied to the binary counter 163, which, in turn, steps the sequencer 164 one step to set the flip-flop 165. The setting of the flip-flop 165, in turn, energizes the light emitting diode 31 to illuminate the head of the hangman transparency 30. The sequencer circuit 164 is stepped in the manner above described for each wrong letter key actuated to set successively flip-flops 172–175 until all the light emitting diodes 31–35 are energized. When this occurs, the game is completed and the other player loses. The flip-flop circuits 165, 172–175 and the light emitting diodes 31–35 comprise an object illuminating circuit 177.

The game ends either when the selected word is fully displayed in the word display 25 or when all of the light emitting diodes 31–35 are energized. To clear the apparatus 10 to play the next game, a player actuates the clear key 21 to reset the binary counter 70 through an OR gate 180, inverter circuit 181 and an OR gate 182. The resetting of the binary counter 70 resets the sequencer circuit 71 to its initial state. The conduction of the OR gate 180 resets the flip-flop circuits 161, 163 and 165, and 172–175. The triggered flip-flop circuits 165, 172–175 are reset to extinguish any energized light emitting diodes 31–35.

The conduction of the inverter circuit 181 through the OR gate 185 resets the binary counter 125. The conduction of the inverter circuit 181 also resets the binary counter 126 through an OR gate 181'. This results in resetting of the binary counter 126. The resetting of the binary counter 126 erases the addresses stored in the RAM memory 125. The conduction of the OR gate 180 also resets the flip-flop circuit 120, which disables the OR gate 141 through an inverter circuit 190. The latches 60–63 are restored to their initial state. Thus, the decoders 84–87 extinguish any energized light emitting diodes 90–93 of the word display 25. The resetting of the flip-flop circuit 120 disables the AND gate 152 to reset the flip-flop circuit 161. Thereupon, the binary counter 162, the binary counter 163 and the sequencer circuit 164 are reset.

I claim:

1. An electronic word game comprising:

(a) a comparator circuit;

(b) a first circuit for applying sequentially to said comparator circuit a first set of signals representing letters of a selected word;

(c) a second circuit for applying successively to said comparator circuit a second set of signals representing letters selected to match the letters represented by said first set of signals;

(d) said comparator circuit producing a first output voltage for each signal of said second set matching a signal of said first set and producing a second output voltage for each signal of said second set failing to match a signal of said first set;

(e) a word display circuit responsive to said first output voltage to display a letter for each matched letter; and (f) an object illuminating circuit responsive to said second output voltage to display segmentally an object for each failure to match a signal of said second set with a signal of said first set.

2. An electronic word game as claimed in claim 1 and comprising a keyboard having a plurality of actuable letter keys, and an encoder circuit translating the actuated letter keys into signals representing the letters of actuated keys, said encoder circuit being connected to said first and second circuits.

3. An electronic word game as claimed in claim 2 wherein said first circuit includes a memory circuit for storing sequentially said first set of signals representing letters of a selected word and applying said first set of signals sequentially to said comparator circuit.

4. An electronic word game as claimed in claim 3 wherein said second circuit connects said encoder circuit to said comparator circuit.

5. An electronic word game as claimed in claim 4 wherein said encoder circuit is connected to said word display circuit for displaying the letters of said first set of signals and said electronic word game further comprising a third circuit connected to said word display circuit for blanking out the displayed letters displayed in said word display circuit and for transferring the first set of signals for storage in said memory circuit and enabling said word display circuit to subsequently display a letter in response to the application of said first output voltage for each matched letter.

6. An electronic word game as claimed in claim 2 wherein said keyboard is connected to said object illuminating circuit for initiating the operation thereof and said object illuminating circuit is disabled in response to said comparator circuit producing said first output voltage.

7. An electronic word game as claimed in claim 2 and comprising a number display circuit connected to said keyboard for displaying the number of letters represented by said first set of signals.

8. An electronic word game comprising:

(a) a letter keyboard circuit having a plurality of actuable letter keys for producing a coded signal in response to the actuation of a letter key representing the letter of the actuated key;

(b) a first circuit connected to said letter keyboard circuit for storing sequentially the coded signals representing a first set of coded signals;

(c) a second circuit connected to said letter keyboard circuit for latching sequentially the first set of coded signals;

(d) a third circuit connected to said letter keyboard circuit, said first circuit and said second circuit for sequencing therein the respective coded signals of said first set of coded signals;

(e) a memory circuit connected to said first circuit for storing therein said first set of coded signals;

(f) a word display circuit connected to said second circuit for displaying the letters represented by said first set of coded signals;

(g) a fourth circuit connected to said third circuit and said letter keyboard circuit for blanking said word display circuit and for advancing the first set of coded signals stored in said first circuit sequentially into said memory circuit at the completion of said first set of coded signals;

(h) a comparator circuit connected to said memory circuit for receiving sequentially said first set of coded signals stored in said memory circuit and connected to said keyboard circuit for receiving in succession a second set of coded signals representing letters selected to match the letters represented by said first set of coded signals, said comparator circuit being connected to said second circuit for successively latching said second circuit for each coded signal of said second set of coded signals matching a coded signal of said first set of coded signals to operate said display circuit for displaying the letters represented by the matched coded signals; and (i) an object illumination circuit connected to said keyboard circuit and said comparator circuit to display an object for each failure to match a coded signal to said second set of coded signals with a coded signal of said first set of coded signals.

9. An electronic word game as claimed in claim 8 wherein said letter keyboard circuit comprises a letter keyboard having a plurality of actuable letter keys, and an encoder circuit connected to said letter keyboard for producing a coded signal in response to the actuation of a letter key representing the letter of the actuated key.

10. An electronic word game as claimed in claim 9 wherein said first circuit comprises a plurality of shift registers connected to said encoder circuit for storing respectively the coded signals representing the actuated keys of said first set of coded signals.

11. An electronic word game as claimed in claim 10 wherein said second circuit comprises a plurality of latch circuits connected to said encoder circuit for receiving respectively the coded signals representing the actuated keys of said first set, said word display circuit being connected to said latch circuits for displaying the letters represented by said first set of coded signals.

12. An electronic word game as claimed in claim 11 and comprising a pulsing circuit connected to said keyboard circuit, said shift registers and said latch circuits for applying sequentially to said shift registers respectively and said latch circuits respectively said coded signals of said first set, said memory circuit being connected to said shift registers for storing therein said first set of coded signals.

13. An electronic word game as claimed in claim 12 wherein said keyboard circuit is connected to said object illuminating circuit for initiating the operation thereof and said object illuminating circuit is disabled in response to said comparator circuit latching said second circuit in response to a coded signal of said first set of coded signals.

14. An electronic word game as claimed in claim 13 and comprising a pulsing circuit connected to said keyboard circuit, said comparator circuit and said object illuminating circuit for operating said object illuminating circuit sequentially in response to the operation of said keyboard circuit during the actuation of the keys for said second set of coded signals for the fragmentary illumination of an object in response to each failure to match a coded signal of said second set of coded signals with a coded signal of said first set of coded signals.

15. An electronic word game as claimed in claim 14 and comprising a number display circuit connected to said keyboard circuit for displaying the number of letters represented by said first set of signals.

* * * * *